US009172214B2

(12) United States Patent
Suzuki

(10) Patent No.: US 9,172,214 B2
(45) Date of Patent: Oct. 27, 2015

(54) SPARK PLUG COMPRISING EARLY RECOVERY FROM A FUEL BRIDGE

(75) Inventor: Kaori Suzuki, Ohbu (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 14/131,937

(22) PCT Filed: May 15, 2012

(86) PCT No.: PCT/JP2012/003156

§ 371 (c)(1),
(2), (4) Date: Jan. 10, 2014

(87) PCT Pub. No.: WO2013/008377

PCT Pub. Date: Jan. 17, 2013

(65) Prior Publication Data

US 2014/0152169 A1 Jun. 5, 2014

(30) Foreign Application Priority Data

Jul. 11, 2011 (JP) ..... 2011-152802

(51) Int. Cl.
*H01T 13/20* (2006.01)
*H01T 13/32* (2006.01)

(52) U.S. Cl.
CPC ..... *H01T 13/20* (2013.01); *H01T 13/32* (2013.01)

(58) Field of Classification Search
CPC ..... H01T 13/20; H01T 13/32
USPC ..... 313/118–145; 123/169 R, 169 EL, 32, 123/41, 310
See application file for complete search history.

(56) References Cited

U.S. PATENT DOCUMENTS

| | | | | |
|---|---|---|---|---|
| 7,605,526 | B2 | 10/2009 | Ishinada et al. | 313/142 |
| 2006/0028107 | A1 | 2/2006 | Hori et al. | 313/141 |
| 2007/0080618 | A1* | 4/2007 | Torii et al. | 313/143 |

(Continued)

FOREIGN PATENT DOCUMENTS

| | | | |
|---|---|---|---|
| CN | 101874331 A | 10/2010 | H01T 13/20 |
| CN | 102067396 A | 5/2011 | H01T 13/20 |

(Continued)

OTHER PUBLICATIONS

Int'l Search Report from corresponding PCT/JP2012/003156 (Form PCT/ISA/210); 2 pages.

(Continued)

*Primary Examiner* — Anne Hines
*Assistant Examiner* — Jose M Diaz
(74) *Attorney, Agent, or Firm* — Kusner & Jaffe

(57) ABSTRACT

A spark plug includes a center electrode, a ceramic insulator provided with an axial hole, a metal shell, and a ground electrode having a facing surface that faces a leading end surface of the center electrode. An annular space is formed between an outer peripheral surface of the center electrode and an inner peripheral surface of the axial hole and is opened toward a leading end side, and when C (mm) is a distance between the outer peripheral surface of the center electrode and the inner peripheral surface of the axial hole in the opening of the annular space, C≥0.2 mm is satisfied. In a cross-section which includes the axial line and is orthogonal to the center axis of the ground electrode, a contour line of lateral surfaces of the ground electrode has a curved shape convexed outward.

4 Claims, 8 Drawing Sheets

(56) References Cited

U.S. PATENT DOCUMENTS

| | | | | |
|---|---|---|---|---|
| 2007/0188065 | A1* | 8/2007 | Ishinada et al. | 313/141 |
| 2009/0309474 | A1 | 12/2009 | Nunome | 313/141 |
| 2010/0275869 | A1* | 11/2010 | Musasa et al. | 123/169 EL |
| 2010/0314987 | A1 | 12/2010 | Kyuno et al. | 313/130 |
| 2011/0089807 | A1 | 4/2011 | Fukuzawa et al. | 313/141 |
| 2011/0175514 | A1* | 7/2011 | Kameda | 313/141 |
| 2013/0009535 | A1* | 1/2013 | Mori | 313/141 |
| 2013/0038198 | A1* | 2/2013 | Torii et al. | 313/141 |
| 2013/0200774 | A1* | 8/2013 | Kikai et al. | 313/141 |

FOREIGN PATENT DOCUMENTS

| | | | | |
|---|---|---|---|---|
| EP | 2216862 A1 | 8/2010 | | H01T 13/20 |
| EP | 2299551 A1 | 3/2011 | | H01T 13/32 |
| JP | 2007-250344 | 7/2007 | | H01T 13/20 |
| JP | 2007-242588 | 9/2007 | | H01T 13/32 |
| JP | 2010-21136 | 1/2010 | | H01T 13/20 |
| JP | 4676912 B2 | 4/2011 | | H01T 13/20 |
| WO | WO 2009/069796 | 6/2009 | | H01T 13/32 |
| WO | WO 2009/153927 | 12/2009 | | H01T 13/39 |

OTHER PUBLICATIONS

Office Action received in corresponding Chinese Patent Application No. 201280034494.4, dated Nov. 25, 2014 (English-language translation provided).

European Search Report issued in corresponding European Patent Application No. 12811417.0-1801, dated Jan. 29, 2015.

* cited by examiner

SPARK PLUG COMPRISING EARLY RECOVERY FROM A FUEL BRIDGE

TECHNICAL FIELD

The present invention relates to a spark plug used in an internal combustion engine.

BACKGROUND ART

The spark plug used in the combustion device such as the internal combustion engine or the like includes, for example, an insulator having an axial hole extending in an axial direction, a center electrode inserted into the axial hole, a metal shell assembled on an outer periphery of the insulator, and a rod-shaped ground electrode having one end fixed to a leading end of the metal shell. Also, a substantially center portion of the ground electrode is bent back, and a spark discharge gap is formed between a leading end of the center electrode and the other end of the ground electrode. When a high voltage is applied to the center electrode, the spark discharge is generated in the spark discharge gap to ignite an air-fuel mixture.

Incidentally, when the spark discharge gap is enlarged due to an electrode wear, or carbon is stuck onto a surface of the insulator, without the generation of a normal spark discharge in the spark discharge gap, there is a risk that a current flows from the center electrode to the metal shell through a surface of the insulator, or a flying spark is generated between the insulator and the metal shell.

Under the circumstances, in order to prevent electric discharge (irregular discharge) outside of the spark discharge gap, there has been proposed a technique of providing an annular space (so-called "thermo clearance") formed between an outer peripheral surface of the leading end side of the center electrode and an inner peripheral surface of the axial hole, and opened toward the leading end side (for example, refer to Patent reference 1). With the provision of the annular space, a distance from the center electrode to the metal shell along the surface of the insulator, or a distance between the center electrode and the leading end of the insulator can be relatively increased, and the generation of the irregular discharge can be more surely suppressed.

PRIOR ART REFERENCE

Patent Reference

Patent reference 1: JP-A-2010-21136

SUMMARY OF INVENTION

Problems to be Solved by the Invention

Incidentally, in order to more enhance the effect of suppressing the irregular discharge, it is preferable to more increase the distance between the center electrode and the insulator in an opening of the annular space. However, as a result of diligent study by the present inventors, it is proved that although the effect of suppressing the irregular discharge can be enhanced with the increase in the above distance, a phenomenon that a fuel adheres to those electrodes to connect between the electrodes (so-called fuel bridge) is liable to occur between the leading end of the center electrode and the other end of the ground electrode (spark discharge gap). From this viewpoint, as a result of further conducting the study by the present inventors, it is proved that an increase in the fuel entering the annular space due to a capillary action with the increase in the above distance mainly causes the fuel bridge to be liable to be generated. It is also proved that if the above distance is particularly set to 0.2 mm or larger, the fuel bridge is liable to be remarkably generated, and a recovery (drop of the fuel) from the fuel bridge is difficult.

The present invention has been made in view of the above circumstances, and an object of the present invention is to enable an early recovery from the fuel bridge in a spark plug in which the distance between the center electrode and the insulator in the opening of the annular space is 0.2 mm or larger.

Means for Solving the Problems

Hereinafter, the respective configurations suitable for solving the above object will be described step by step. The function effects specific to the corresponding configuration will be noted as occasion demands.

Configuration 1

A spark plug of this configuration includes a center electrode extending in an axial direction; a cylindrical insulator provided with an axial hole into which the center electrode is inserted; a cylindrical metal shell disposed on an outer periphery of the insulator; and a ground electrode having one end fixed to a leading end of the metal shell and another end having a facing surface that faces a leading end surface of the center electrode, wherein the spark plug has an annular space which is formed by an outer peripheral surface of the center electrode and an inner peripheral surface of the axial hole and is opened toward a leading end side in the axial direction, wherein, when C (mm) is a distance between the outer peripheral surface of the center electrode and the inner peripheral surface of the axial hole in an opening of the annular space along a direction orthogonal to the axial line, $C \geq 2$ mm is satisfied, and wherein, in a cross-section which includes the axial line and is orthogonal to the center axis of the ground electrode, a contour line of a lateral surface of the ground electrode, which is adjacent to the facing surface, has a curved shape which is convexed outward.

Configuration 2

A spark plug of this configuration is the spark plug according to the configuration 1, wherein a contour line of the facing surface is linearly shaped in the cross-section, and wherein, when B (mm) is an outer diameter of the leading end surface of the center electrode, and D (mm) is a length of the contour line of the facing surface in the cross-section, $D \leq B$ is satisfied.

Configuration 3

A spark plug of this configuration is the spark plug according to the configuration 1 or 2, wherein a contour line of the facing surface is linearly shaped in the cross-section, and wherein, when B (mm) is an outer diameter of the leading end surface of the center electrode, and D (mm) is a length of the contour line of the facing surface in the cross-section, $0.72 \times B \leq D$ is satisfied.

Configuration 4

A spark plug of this configuration is the spark plug according to any one of the configurations 1 to 3, wherein a contour line of the facing surface is linearly shaped in the cross-section, and wherein, when B (mm) is an outer diameter of the leading end surface of the center electrode, and D (mm) is a length of the contour line of the facing surface in the cross-section, $|(D-B)/2| \leq 0.25$ mm is satisfied.

Configuration 5

A spark plug of this configuration is the spark plug according to any one of the configurations 1 to 4, wherein an outer peripheral surface of the metal shell includes a screw portion configured to be screwed with a fitting hole of a combustion device, wherein the ground electrode includes a gap correspondence portion which is a portion at the leading end side of the leading end surface of the center electrode in the axial direction and at a rear end side of the facing surface of the ground electrode in the axial direction, and, wherein, when M (mm) is a screw diameter of the screw portion, and X (mm) is a width of the gap correspondence portion, $M/X \geq 5.25$ is satisfied.

The gap correspondence portion is a site of the ground electrode which is located at the same height as that of the spark discharge gap in the axial direction, which is a site of the ground electrode which particularly inhibits an inflow of the air-fuel mixture into the spark discharge gap.

Advantage of the Invention

According to the spark plug of the configuration 1, because the annular space having the distance C of 0.2 mm or larger is provided, the generation of the irregular discharge can be effectively suppressed.

On the other hand, when the distance C is set to 0.2 mm or larger, the fuel bridge is liable to be generated, and the early recovery from the fuel bridge becomes difficult. However, according to the spark plug of the configuration 1, in a cross-section which includes the axial line and is orthogonal to the center axis of the ground electrode, a contour line of a lateral surface of the ground electrode is formed into a curved shape convexed outward. Therefore, the bridge-shaped fuel connecting between the center electrode and the ground electrode is liable to flow toward the lateral surface side of the ground electrode. As a result, the fuel early drops, and the early recovery from the fuel bridge can be conducted.

Also, when the lateral surface of the ground electrode is formed into the curved surface shape, in applying the air-fuel mixture to a back side of the ground electrode, the air-fuel mixture becomes liable to flow into the spark discharge gap by coming around the ground electrode without separating from the lateral surface of the ground electrode. As a result, as described above, in combination with a fact that the generation of the irregular discharge can be effectively suppressed, an ignition property can be dramatically improved.

According to the spark plug of the configuration 2, the contour line of the facing surface of the ground electrode is linearly shaped in the cross-section. Therefore, the facing surface becomes substantially evenly worn with the electric discharge, and the durability can be improved.

On the other hand, when the contour line of the facing surface is linearly shaped, the fuel is liable to pool on the facing surface. For that reason, a concern about the generation of the fuel bridge is increased. However, in the spark plug of the configuration 2, when B (mm) is an outer diameter of the leading end surface of the center electrode, and D (mm) is a length of the facing surface in the cross-section, it is configured that D is satisfied. Accordingly, since the lateral surface of the ground electrode which is formed into the curved surface shape is located below the fuel flowing out of the annular space, most of the fuel flows to a lateral surface side of the ground electrode. As a result, the fuel hardly pools on the facing surface of the ground electrode, and the early recovery effect from the fuel bridge can be more improved.

According to the spark plug of the configuration 3, it is configured that $0.72 \times B \geq D$ is satisfied, and a length D corresponding to the worn volume of the ground electrode is sufficiently large with respect to an outer diameter B of the leading end surface of the center electrode. Therefore, a rapid enlargement of the spark discharge gap attributable to the spark discharge can be more surely prevented, and the durability can be further improved.

According to the spark plug of the configuration 4, it is configured that $|(D-B)/2| \leq 0.25$ mm is satisfied, and the outer diameter B is substantially equal to the length D. Accordingly, the spark discharge is generated between the overall area of the leading end surface of the center electrode and the overall area of the facing surface of the ground electrode. For this reason, a case in which only a part of the leading end surface of the center electrode or the facing surface of the ground electrode is disproportionately worn can be more surely prevented, and the center electrode or the ground electrode can be effectively used. As a result, the rapid enlargement of the spark discharge gap can be more surely suppressed, and the durability can be further improved.

When a distance from the spark discharge gap to a gap correspondence portion along the radial direction is different according to a screw diameter of a screw portion, according to the spark plug of the configuration 5, a width X (mm) of the gap correspondence portion is set to be sufficiently small according to a screw diameter M (mm) of the screw portion corresponding to the distance along the radial direction. For that reason, the air-fuel mixture is liable to more flow into the spark discharge gap with the result that the ignition property can be further improved.

MODE FOR CARRYING OUT THE INVENTION

Figure 1:
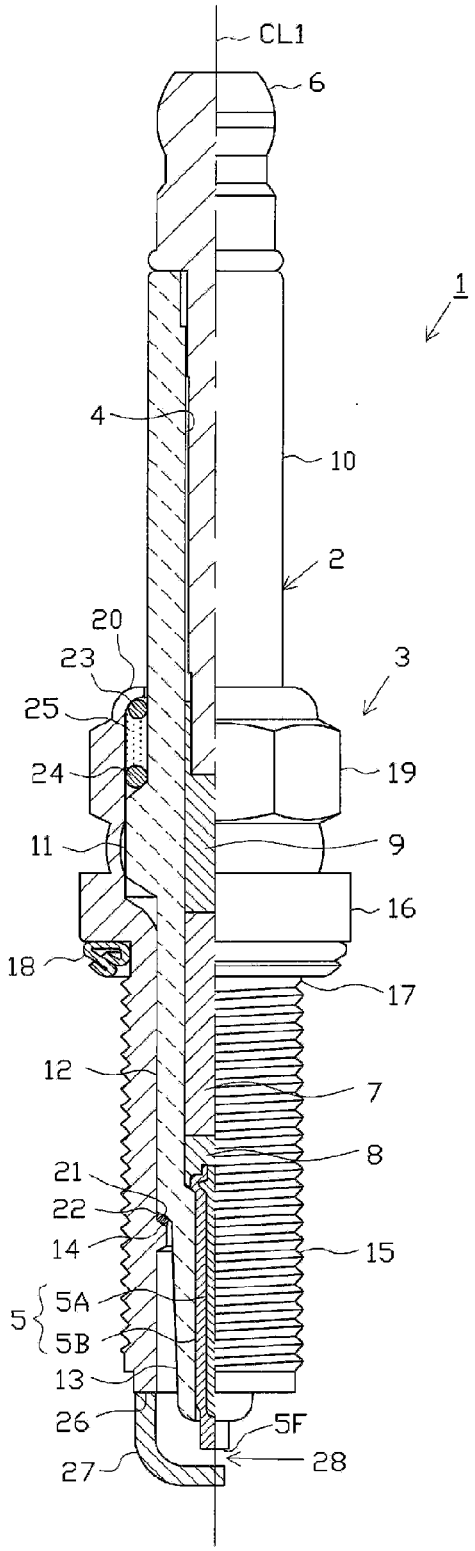
FIG. 1 is a partially broken front view illustrating a configuration of a spark plug.

Hereinafter, embodiments will be described with reference to the drawings. FIG. 1 is a partially broken front view illustrating a spark plug 1. In FIG. 1, a description will be made assuming that a direction of an axis CL1 of the spark plug 1 is a vertical direction of the drawing, a lower side is a leading end side of the spark plug 1, and an upper side is a rear end side.

The spark plug 1 includes a ceramic insulator 2 forming a cylindrical insulator, and a cylindrical metal shell 3 that holds the ceramic insulator 2.

The ceramic insulator 2 is formed by firing alumina or the like as well known. The ceramic insulator 2 includes, in a contour portion thereof, a rear end side body portion 10 which is formed on a rear end side thereof, a large-diameter portion 11 which is protruded outward in a radial direction on a leading end side relative to the rear end side body portion 10, a middle body portion 12 which is formed to be thinner in diameter than the large-diameter portion 11 on the leading end side relative to the large-diameter portion 11, and a nose length portion 13 which is formed to be thinner in diameter than the middle body portion 12 on the leading end side relative to the middle body portion 12, in a contour portion thereof. In addition, in the ceramic insulator 2, the large-diameter portion 11, the middle body portion 12, and most of the nose length portion 13 are housed inside of the metal shell 3. A tapered step 14 is formed to a connection portion of the middle body portion 12 and the nose length portion 13, and the ceramic insulator 2 is locked to the metal shell 3 by the step 14.

Further, an axial hole 4 that extends along the axis CL1 is penetrated through the ceramic insulator 2, and a center electrode 5 of a bar shape (columnar shape) is fixedly inserted into the leading end side of the axial hole 4. The center electrode 5 include an inner layer 5A made of a high thermal conductive metal (for example, copper, copper alloy, pure nickel (Ni), or the like), and an outer layer 5B made of a Ni alloy which mainly contains Ni. A leading end surface 5F of the center electrode 5 is formed into a flat shape, and the leading end of the center electrode 5 is protruded from a leading end of the ceramic insulator 2.

In addition, a terminal electrode 6 is fixedly inserted into a rear end side of the axial hole 4 in a state where the terminal electrode 6 is protruded from a rear end of the ceramic insulator 2.

Further, a columnar resistor 7 is arranged between the center electrode 5 of the axial hole 4 and the terminal electrode 6. Both ends of the resistor 7 are electrically connected to the center electrode 5 and the terminal electrode 6 through electrically conductive glass seal layers 8 and 9, respectively.

The metal shell 3 is made of metal such as a low carbon steel, and formed into a cylindrical shape, and a screw portion 8, and a screw portion (male screw portion) 15 for screwing the spark plug 1 into a fitting hole of a combustion device such as an internal combustion engine, a fuel cell reformer, or the like is formed on an outer peripheral surface of the metal shell 3. Also, a seat portion 16 is formed on a rear end side of the screw portion 15 so as to be protruded toward the outer peripheral side, and a ring-shaped gasket 18 is fitted around a thread neck 17 of the rear end of the screw portion 15. Further, a tool engagement portion 19 having a hexagonal shape in cross-section to be engaged with a tool such as a wrench when fitting the metal shell 3 to the combustion device is disposed on a rear end side of the metal shell 3. Also, a crimping portion 20 bent inward in the radial direction is disposed on the rear end of the metal shell 3.

In addition, a tapered step 21 for locking the ceramic insulator 2 is provided on the inner peripheral surface of the metal shell 3. The ceramic insulator 2 is inserted from the rear end side of the metal shell 3 toward the leading end side thereof. Then, in a state where the step 14 of the ceramic insulator 2 is locked with the step 21 of the metal shell 3, the opening portion of the rear end side of the metal shell 3 is crimped inward in the radial direction, that is, the crimping portion 20 is formed so that the ceramic insulator 2 is fixed to the metal shell 3. An annular plate packing 22 is interposed between the respective steps 14 and 21 of the ceramic insulator 2 and the metal shell 3. As a result, the airtightness within the combustion chamber is held, and the fuel gas that enters the gap between the nose length portion 13 of the ceramic insulator 2 and the inner peripheral surface of the metal shell 3, which is exposed to the interior of the combustion chamber, is prevented from being leaked to the external.

Further, in order to more complete the seal by crimping, ring members 23 and 24 are interposed between the metal shell 3 and the ceramic insulator 2 on the rear end side of the metal shell 3, and a gap between the ring members 23 and 24 is filled with powders of talc (talc) 25. That is, the metal shell 3 holds the ceramic insulator 2 through the plate packing 22, the ring members 23, 24 and the talc 25.

Figure 2:
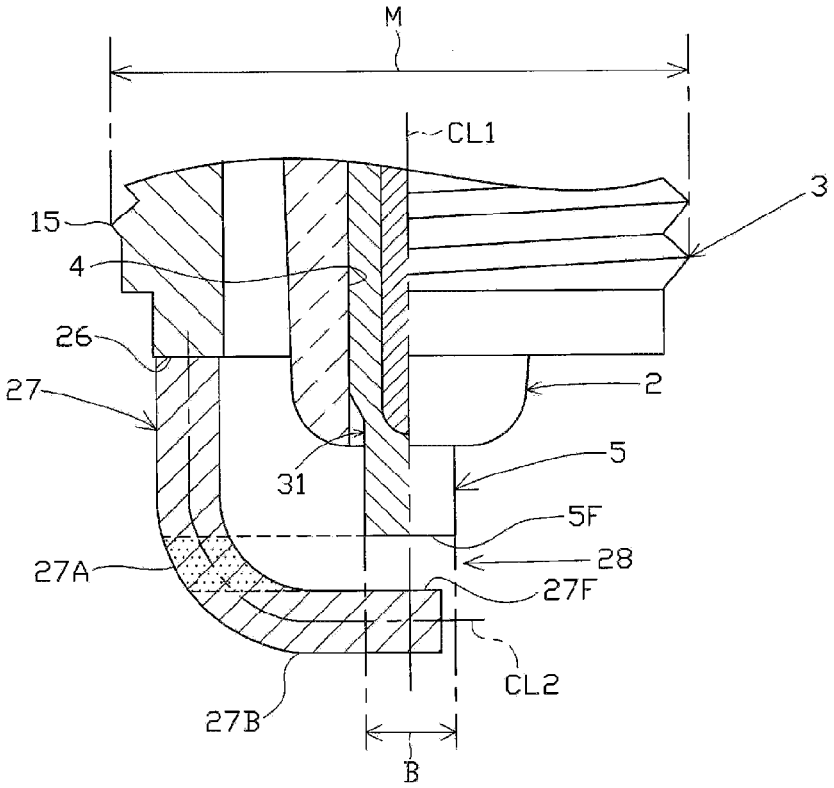
FIG. 2 is a partially broken enlarged front view illustrating the configuration of a leading end portion of the spark plug.
Figure 3:
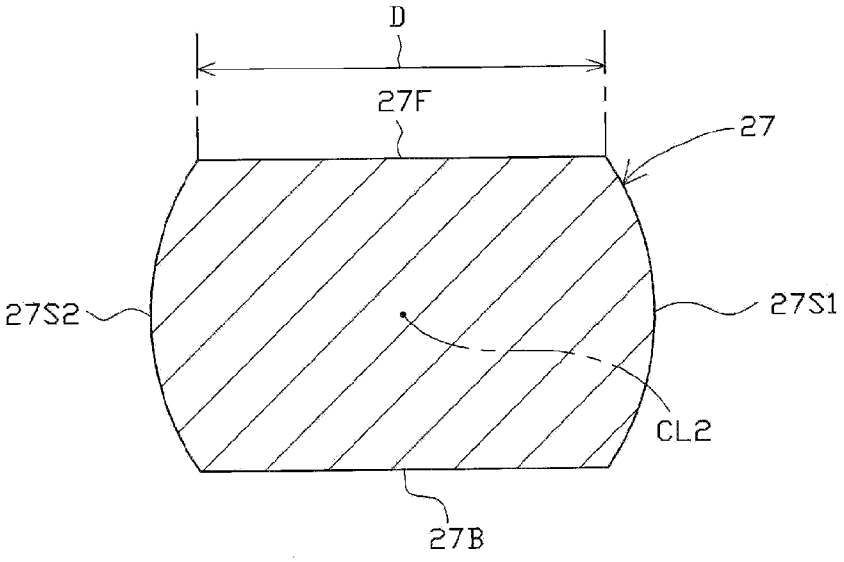
FIG. 3 is an enlarged cross-sectional view illustrating a cross-sectional shape of a ground electrode in a cross-section including an axial line, and being orthogonal to a center axis of the ground electrode.

Also, as illustrated in FIG. 2, a leading end portion 26 of the metal shell 3 is joined to one end portion of a rod-shaped ground electrode 27. The ground electrode 27 is made of alloy mainly containing Ni, and bent back toward the center electrode 5 side in a substantially middle portion thereof. In this embodiment, the ground electrode 27 is configured to have a given width along a longitudinal direction thereof. Also, as illustrated in FIGS. 2 and 3, a facing surface 27F of the ground electrode 27, which faces the leading end surface 5F of the center electrode 5, is formed into a flat shape. That is, the contour line of the facing surface 27F is formed into a linear shape in a cross-section that includes the axis CL1, and is orthogonal to a center axis CL2 of the ground electrode 27. In addition, in the above cross-section, the center of the facing surface 27F in the width direction faces the center of the leading end surface 5F of the center electrode 5. Also, in this embodiment, the other end of the ground electrode 27 is protruded toward a side separated from one end of the ground electrode 27 relative to the axis CL1, and the area of the facing surface 27F is sufficiently increased.

Further, a back surface 27B of the ground electrode 27, which is located on a rear side of the center electrode 5 side, is also formed into a flat shape as with the facing surface 27F. In general, after the ground electrode 27 has been joined to the metal shell 3 in a state of a straight bar shape, the back surface 27B is pressed so as to be bent back toward the center electrode 5 side. However, since the back surface 27B is formed into a flat shape, the ground electrode 27 can be bent back toward the axis CL1 side with a high precision. Therefore, a center of the facing surface 27F of the ground electrode 27 in the width direction can more surely face a center of the leading end surface 5F of the center electrode 5.

In addition, a spark discharge gap 28 is formed between the leading end surface 5F of the center electrode 5 and the facing surface 27F of the ground electrode 27, and a spark discharge is conducted in the spark discharge gap 28 in a direction substantially along the axis CL1.

Figure 4:
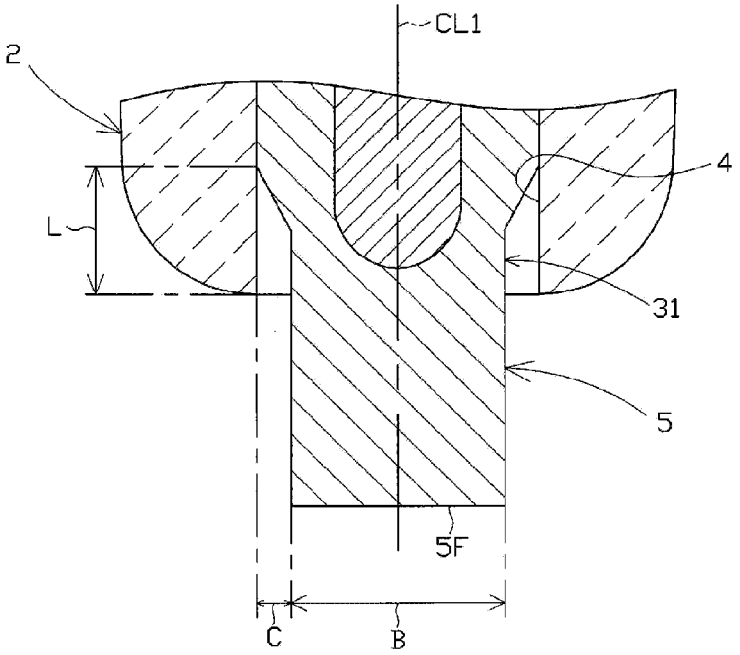
FIG. 4 is a partially enlarged cross-sectional view illustrating an annular space formed between a center electrode and a ceramic insulator.

Further, in this embodiment, the leading end side of the ceramic insulator 2 is formed with an annular space 31 that is formed by the outer peripheral surface of the center electrode 5 and the inner peripheral surface of the axial hole 4, and opened toward the leading end side in the direction of the axis CL1. The annular space 31 is formed by slightly thinning the leading end of the center electrode 5, and also the size of the opening of the annular space 31 along the direction orthogonal to the axis CL1 is relatively large. Specifically, as illustrated in FIG. 4, when C (mm) is a distance between the outer peripheral surface of the center electrode 5 and the inner peripheral surface of the axial hole 4 in the opening of the annular space 31 along the direction orthogonal to the axis CL1, it is configured such that C0.2 mm is satisfied. Also, in this embodiment, a length (depth) L along the axis CL1 of the annular space 31 is set to a given value (for example, 0.1 mm), and a volume of the annular space 31 is relatively large (when the length L is equal to or larger than 0.1 mm, the generation of the so-called fuel bridge and the prolongation of the fuel bridge is apprehended, and when the length L is equal to or larger than 0.5 mm, the generation of the so-called fuel bridge and the prolongation of the fuel bridge are more apprehended). In addition, the distance C is set to the given value (for example, 0.5 mm) or lower, so as to ensure the strength of the ceramic insulator 2 located on the outer periphery of the annular space 31. With this given value, the fuel is liable to enter the annular space 31 by the aid of a capillary action.

Incidentally, as in this embodiment, when the annular space 31 having the relatively large opening is provided, or when the other end of the ground electrode 27 is protruded from the axis CL1, the fuel bridge is liable to be generated between the leading end of the center electrode 5 and the other end of the ground electrode 27. Taking this point into consideration, in this embodiment, the shape of the ground electrode 27 can be set as follows.

That is, as illustrated in FIG. 3, in the cross-section that includes the axis CL1 and is orthogonal to the center axis CL2 of the ground electrode 27, the contour line of both the lateral surfaces 27S1 and 27S2 of the ground electrode 27 adjacent to the facing surface 27F is formed into the curved shape convexed outward. Also, in this embodiment, a portion of the ground electrode 27, which has the largest width, is formed on the back surface 27B side relative to the facing surface 27F in the above cross-section. That is, when the ground electrode 27 is viewed from the spark discharge gap 28 side, at least a part of the both lateral surfaces 27S1 and 27S2 of the ground electrode 27 is visible. Here, the "width of the ground electrode 27" represents the width of the ground electrode 27 along a direction orthogonal to both of the axis CL1 and the center axis CL2 of the ground electrode 27.

Also, the radius of curvature of the contour line of both the lateral surfaces 27S1 and 27S2 in the above cross-section is prevented from being excessively large (for example, the largest value or lower of the ground electrode 27). Further, at least a portion of the lateral surfaces 27S1 and 27S2 of the ground electrode 27, which extends from a gap correspondence portion 27A to be described later to the other end of the ground electrode 27 (an overall are of the lateral surfaces 2751 and 27S2 of the ground electrode 27 in this embodiment) is formed into a curved surface shape.

In addition, in this embodiment, the width of the facing surface 27F is configured to be relatively small. That is, as illustrated in FIGS. 2 and 3, when B (mm) is an outer diameter of the leading end surface 5F of the center electrode 5, and D (mm) is a length of the contour line of the facing surface 27F in the above cross-section, it is configured such that $D \geq B$ is satisfied.

On the other hand, the facing surface 27F of the ground electrode 27 is configured to have a sufficient area so as to suppress the rapid enlargement of the spark discharge gap 28 which is attributable to the spark discharge, or the like, and in this embodiment, it is configured such that $0.72 \times B \leq D$.

Further, in this embodiment, an outer diameter B (mm) of the facing surface 5F of the center electrode 5 and a length D (mm) of the contour line of the facing surface 27F in the above cross-section are configured to satisfy $|(D-B)/2| \leq 0.25$ mm, and the outer diameter B and the length D are set to be substantially equal to each other.

Figure 5:
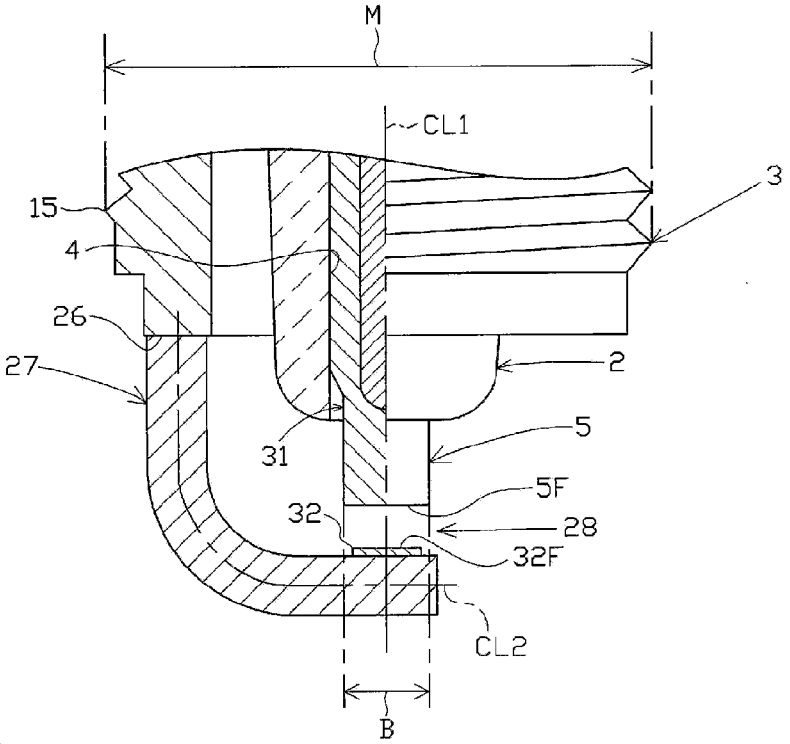
FIG. 5 is a partially broken enlarged front view illustrating an example in which a chip is disposed on the ground electrode.
Figure 6:
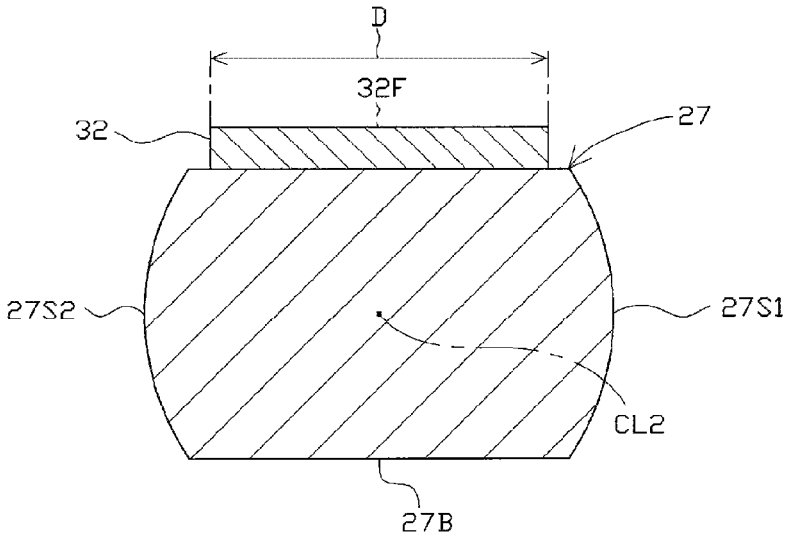
FIG. 6 is an enlarged cross-sectional view illustrating a cross-sectional shape of the ground electrode in the cross-section including the axial line, and being orthogonal to the center axis of the ground electrode when the chip is disposed on the ground electrode.

As illustrated in FIGS. 5 and 6, the other end of the ground electrode 27 may be provided with a chip 32 made of metal (for example, indium alloy, platinum alloy, or the like) excellent in abrasion resistance, and the chip 32 may be configured to face the leading end surface 5F of the center electrode 5. In this case, the "facing surface of the ground electrode 27" represents a facing surface 32F that faces the leading end surface 5F of the center electrode 5 in the chip 32. Therefore, when the chip 32 is provided, the length D (mm) of the facing surface 32F in the above cross-section is configured to satisfy the above expressions ($0.72 \times B \leq D \leq B$, and $|(D-B)/2| \leq 0.25$ mm) with respect to the outer diameter B (mm) of the leading end surface 5F of the center electrode 5.

Figure 7:
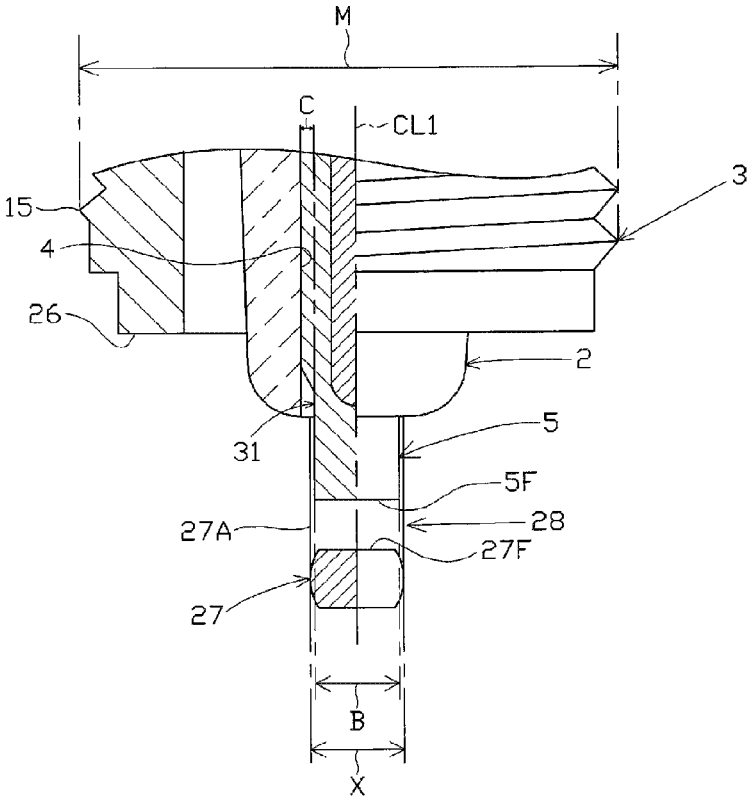
FIG. 7 is a partially broken enlarged side view illustrating a configuration of a leading end of the spark plug.

Further, as illustrated in FIG. 7, when X (mm) is a width of a gap correspondence portion 27A (site indicated with a scattered pattern in FIG. 2) which is a portion located on the leading end side relative to the leading end surface 5F of the center electrode 5 in the axis CL1, and also located on the rear end side relative to the facing surface 27F of the ground electrode 27 in the axis CL1, and M (mm) is the screw diameter of the screw portion 15, it is configured such that $M/X \geq 5.25$ is satisfied.

As described in detail above, according to this embodiment, because the annular space 31 having the distance C of 0.2 mm or larger is provided, the generation of the irregular discharge can be effectively suppressed.

On the other hand, when the distance C is set to 0.2 mm or larger, the fuel bridge is liable to be generated, and the early recovery from the fuel bridge may become difficult. However, in this embodiment, in the cross-section that includes the axis CL1 and is orthogonal to the center axis CL2 of the ground electrode 27, the contour line of both the lateral surfaces 27S 1 and 27S2 of the ground electrode 27 is formed into the curved shape convexed outward. Therefore, the bridge-shaped fuel is liable to flow toward the lateral surfaces 27S1 and 27S2 of the ground electrode 27. As a result, the fuel early drops, and the early recovery from the fuel bridge can be conducted.

Also, when the lateral surfaces 27S1 and 27S2 of the ground electrode 27 is formed into the curved surface shape to apply the air-fuel mixture to the back side of the ground electrode 27, the air-fuel mixture becomes liable to flow into the spark discharge gap 28 by coming around the ground electrode 27 without separating from the lateral surfaces 27S1 and 27S2 of the ground electrode 27. As a result, as described above, in combination with a fact that the generation of the irregular discharge can be effectively suppressed, an ignition property can be dramatically improved.

Further, in this embodiment, the contour line of the facing surface 27F is linear in the above cross-section. Therefore, the facing surface 27F is substantially evenly worn together with the electric discharge, and the durability can be improved.

In addition, because D≤B is satisfied, the lateral surfaces 27S1 and 27S2 of the ground electrode 27 which is formed into the curved surface shape is located below the fuel flowing out of the annular space 31 whereby most of the fuel flows into the lateral surfaces 27S1 and 27S2 side of the ground electrode 27. As a result, the fuel hardly pools on the facing surface 27F of the ground electrode 27, and the early recovery effect from the fuel bridge can be more improved.

In addition, it is configured that 0.72×B≤D is satisfied, and the worn volume of the ground electrode 27 is sufficiently ensured with respect to the outer diameter B of the leading end surface 5F of the center electrode 5. Therefore, the rapid enlargement of the spark discharge gap 28 attributable to the spark discharge can be more surely prevented, and the durability can be further improved.

Also, it is configured that |(D−B)/2|≤0.25 mm is satisfied, and the outer diameter B and the length D are set to be substantially equal to each other. Therefore, the spark discharge is generated between the overall area of the leading end surface 5F and the overall area of the facing surface 27F. For this reason, a case in which only a part of the leading end surface 5F or the facing surface 27F is disproportionately worn can be more surely prevented, and the center electrode 5 or the ground electrode 27F can be effectively used. As a result, the rapid enlargement of the spark discharge gap 28 can be more surely suppressed, and the durability can be further improved.

Further, it is configured that M/X≥5.25 is satisfied, and the width X (mm) of the gap correspondence portion is sufficiently small according to the screw diameter M (mm) of the screw portion 15. For that reason, the air-fuel mixture is liable to more flow into the spark discharge gap 28, and the ignition property can be further improved.

Figure 8:
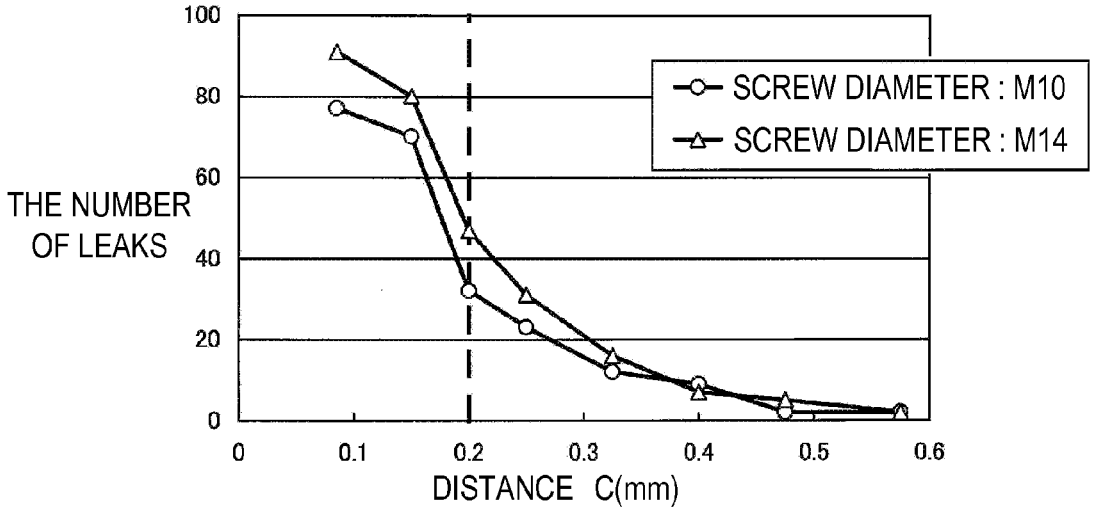
FIG. 8 is a graph illustrating a leak resistance evaluation test in a sample in which a distance C is variously changed.

Subsequently, for the purpose of confirming the action effect obtained by the above embodiment, samples of the spark plug in which the screw diameter of the screw portion is set M10 or M14, the distance C (mm) of the annular space is variously changed are prepared, and the leak resistance evaluation test is conducted on the respective samples. The outline of the leak resistance evaluation test will be described below. That is, each sample is fitted to a given chamber, and a pressure within the chamber is set to 1.2 MPa, and a voltage is applied to each sample from a given power supply by 100 times. Then, the number of electric discharge (the number of leaks) generated along the surface of the ceramic insulator is measured on a site other than the spark discharge gap. FIG. 8 illustrates the test results of the above test. Referring to FIG. 8, the test results of the sample in which the screw diameter is M10 are indicated by circles, and the test results of the sample in which the screw diameter is M14 are indicated by triangles. Also, in each of the samples, the center electrode and the ground electrode are made of metal mainly containing Ni therein.

As illustrated in FIG. 8, it is found that the sample in which the distance C is set to be equal to or larger than 0.2 mm is largely decreased in the number of leaks, and the spark discharge (irregular discharge) outside of the spark discharge gap can be effectively prevented. It is conceivable that this is because the opening width of the annular space is increased so that the distance between the center electrode and the metal shell along the surface of the ceramic insulator, and the distance between the center electrode and the leading end of the ceramic insulator can be relatively increased.

From the viewpoints of the results of the above test, it is preferable that in order to suppress the generation of the irregular discharge, and more surely generate the spark discharge in the spark discharge gap, C≥0.2 mm is satisfied in the configuration.

Figure 9:
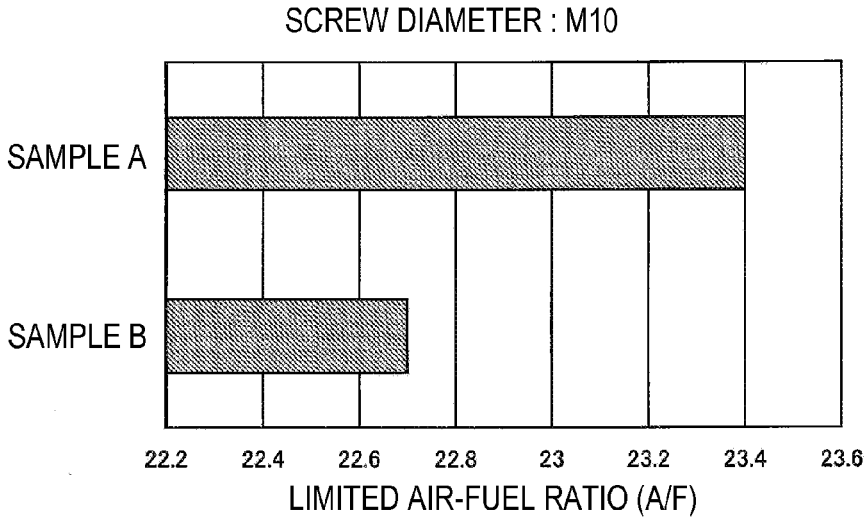
FIG. 9 is a graph illustrating a result of an ignition property evaluation test of samples A and B when a screw diameter of a screw portion is M10.

Then, a sample (sample A corresponding to an example) of the spark plug in which the screw diameter of the screw portion is M10 or M14, and both of the lateral surfaces of the ground electrode is formed into the curved surface shape convexed outward, and a sample (sample B corresponding to a comparative example) of the spark plug in which both of the lateral surfaces of the ground electrode is formed into a flat shape are prepared, and the ignition property evaluation test is conducted on both of those samples. The outline of the ignition property evaluation test will be described below. That is, the sample is attached to a four-cylinder engine of 1.5 L displacement so that the ground electrode is arranged at a position located by 90 degrees with the axis as a rotating axis from a state in which the ground electrode is directed toward a fuel injection outlet side (most preferable position from the viewpoint of the ignition property), and the engine is operated with an ignition timing as an MBT (most suitable location for ignition). Then, a variation of an engine torque is measured for each of air-fuel ratios while the air-fuel ratios are gradually increased (fuel is diluted), and the air-fuel ratio when the variation of the engine torque exceeds 5% is specified as the air-fuel ratio. The limited air-fuel ratio being larger means that the ignition property is better. FIG. 9 illustrates the test results of the sample in which the screw diameter is M10, and FIG. 10 illustrates the test results of the sample in which the screw diameter is M14.

Figure 10:
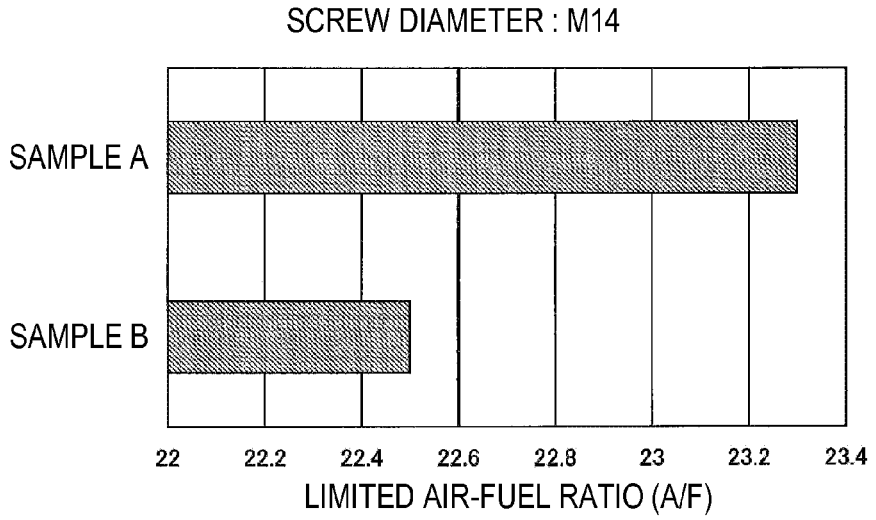
FIG. 10 is a graph illustrating a result of the ignition property evaluation test of the samples A and B when the screw diameter of the screw portion is M14.

As illustrated in FIGS. 9 and 10, it is found that the sample A in which both the lateral surfaces of the ground electrode are formed into a curved surface shape has the excellent ignition property. It is conceivable that this is because when the air-fuel mixture is applied to the back side of the ground electrode, the air-fuel mixture easily flows into the spark discharge gap so as to come around the ground electrode without separating from the lateral surfaces of the ground electrode.

From the viewpoints of the results of the above test, in order to improve the ignition property, it is preferable that, in the cross-section that includes the axis and is orthogonal to the center axis of the ground electrode, the contour line of the lateral side of the ground electrode is formed into the curved shape convexed outward.

A tumble swirl (air swirl) is generated within the combustion chamber, and even when there is a difference in the arranged position of the ground electrode with respect to the fuel injection outlet and an outlet, inhibition of fuel influx into the spark discharge gap occurs due to the existence of the ground electrode. In this example, as described above, even when the ground electrode is fitted to the most preferable position from the viewpoint of the ignition property, and an influence of the inhibition of the air-fuel mixture influx caused by the ground electrode is relatively small, the lateral surfaces of the ground electrode are formed into the curved surface shape, thereby being capable of improving the ignition property. For that reason, when the influence of the inhibition of the air-fuel mixture influx caused by the existence of the ground electrode is large, for example, when the ground electrode is arranged between the fuel injection outlet and the spark discharge gap, it is conceivable that an improvement effect of the ignition property caused by forming the lateral surface of the ground electrode into the curved surface shape is more remarkably exerted.

Then, 5 samples are made for each of the above samples A and B in which the screw diameter of the screw portion is M10 or M14, and the distance C is set to 0.2 mm or larger, and the fuel bridge evaluation test is conducted on each of the samples. The outline of the fuel bridge evaluation test will be described below. That is, a given amount of fuel is poured into a clearance formed between the outer peripheral surface of the nose length portion of the ceramic insulator and the inner peripheral surface of the metal shell, and then the leading end of the sample is directed downward. The leading end of each sample is directed downward so that the fuel travels toward the spark discharge gap side, and a part of the fuel enters the annular space due to the capitally phenomenon, and gradually drops from the interior of the annular space toward the spark discharge gap side (because the distance C is set to 0.2 mm or larger, a large amount of fuel enters the annular space, and the fuel bridge is liable to be maintained for a long period). Then, the sample is left for 5 minutes after the leading end of the sample has been directed downward, the spark discharge gap is then observed, and it is confirmed whether the fuel bridge is present in the spark discharge gap or not. In this example, if the fuel bridge is not confirmed, the evaluation of "O" representing that the spark discharge gap can be early recovered from the fuel bridge is given. On the other hand, when the fuel bridge is confirmed, the evaluation of "X" representing that the early recovery from the fuel bridge is difficult is given. Table 1 represents the test results of the samples in which the screw diameter is M10, and Table 2 represents the test results of the samples in which the screw diameter is M14. In the samples in which the screw diameter is M10, the width of the ground electrode is set to 2.1 mm, and in the samples in which the screw diameter is M14, the width of the ground electrode is set to 2.6 mm. Also, in each of the samples, the center electrode and the ground electrode are made of metal mainly containing Ni therein.

TABLE 1

| Screw Diameter: M10 | | |
|---|---|---|
| No. | Sample A | Sample B |
| 1 | ○ | X |
| 2 | ○ | ○ |
| 3 | ○ | ○ |
| 4 | ○ | X |
| 5 | ○ | X |

TABLE 2

| Screw Diameter: M14 | | |
|---|---|---|
| No. | Sample A | Sample B |
| 1 | ○ | X |
| 2 | ○ | X |
| 3 | ○ | X |
| 4 | ○ | ○ |
| 5 | ○ | X |

As shown in Table 1 and Table 2, it is confirmed the samples A in which the lateral surface of the ground electrode is formed into the curved surface shape can be early recovered from the fuel bridge. It is conceivable that this is because the fuel is liable to flow into the lateral surface side of the ground electrode as a result of which the fuel early drops.

From the results of the above test, in the spark plug in which the fuel bridge is liable to be remarkably generated and the recovery from the fuel bridge is difficult due to the distance C of the annular space being set to 0.2 mm or larger, in order to conduct the early recovery from the fuel bridge, it is preferable that, in the cross-section that includes the axis and is orthogonal to the center axis of the ground electrode, the contour line of the lateral side of the ground electrode is formed into the curved shape convexed outward.

Subsequently, samples in which the screw diameter of the screw portion is M10 or M14, the lateral surface of the ground electrode is formed into the curved surface shape, and the length D (mm) of the contour line of the facing surface of the ground electrode is variously changed are made, and the above fuel bridge evaluation test is conducted on each of the samples. In this test, it is confirmed whether the fuel bridge is present in the spark discharge gap or not, 15 seconds after the leading end of the sample has been directed downward (that is, a condition in which the fuel bridge is more liable to be confirmed). Table 3 represents the test results of the samples in which the screw diameter is M10, and Table 4 represents the test results of the samples in which the screw diameter is M14. In the samples in which the screw diameter is M10, the width of the ground electrode is set to 2.1 mm, and the outer diameter B of the leading end surface of the center electrode is set to 1.9 mm. Also, in the samples in which the screw diameter is M14, the width of the ground electrode is set to 2.6 mm, and the outer diameter of the leading end surface of the center electrode is set to 2.3 mm. Further, in each of the samples, the distance C of the annular space is set to 0.2 mm or larger.

TABLE 3

| Screw Diameter: M10, Outer Diameter B: 1.9 mm | | |
|---|---|---|
| Length D (mm) | Relational Expression of Length D to Outer Diameter B | Evaluation |
| 2.1 | D > B | X |
| 2.0 | D > B | X |
| 1.9 | D = B | ○ |
| 1.7 | D < B | ○ |

TABLE 4

| Screw Diameter: M14, Outer Diameter B: 2.3 mm | | |
|---|---|---|
| Length D (mm) | Relational Expression of Length D to Outer Diameter B | Evaluation |
| 2.5 | D > B | X |
| 2.4 | D > B | X |
| 2.3 | D = B | ○ |
| 2.0 | D < B | ○ |
| 1.8 | D < B | ○ |

As shown in Table 3 and Table 4, it becomes evident that the spark discharge gap can be further early recovered from the fuel bridge by setting the length D to be the outer diameter B of the leading end surface of the center electrode or smaller. It is conceivable that this is because the lateral surfaces of the ground electrode which is formed into the curved surface shape is located below the fuel flowing out of the annular space, and therefore most of the fuel flows into the lateral surface side of the ground electrode, thereby making it difficult that the fuel pools on the facing surface of the ground electrode.

Subsequently, samples of the spark plug in which the screw diameter of the screw portion is M10 or M14, the lateral surface of the ground electrode is formed into the curved surface shape, and a chip in which the length D (mm) of the surface that faces the center electrode in the cross-section including the axis is variously changed is provided on the ground electrode are made, and the above fuel bridge evaluation test is conducted on each of the samples. In this test, it is confirmed whether the fuel bridge is present in the spark discharge gap or not, 15 seconds after the leading end of the sample has been directed downward. Table 5 represents the test results of the samples in which the screw diameter is M10, and Table 6 represents the test results of the samples in which the screw diameter is M14. The width of the ground electrode, the outer diameter of the leading end surface of the center electrode, and so on is identical with those in the above test.

TABLE 5

| Screw Diameter: M10, Outer Diameter B: 1.9 mm, With Chip | | |
|---|---|---|
| Length D (mm) | Relational Expression of Length D to Outer Diameter B | Evaluation |
| 2.2 | D > B | X |
| 2.0 | D > B | X |
| 1.9 | D = B | ○ |
| 1.7 | D < B | ○ |

TABLE 6

| Screw Diameter: M14, Outer Diameter B: 2.3 mm, With Chip | | |
|---|---|---|
| Length D (mm) | Relational Expression of Length D to Outer Diameter B | Evaluation |
| 2.5 | D > B | X |
| 2.4 | D > B | X |
| 2.3 | D = B | ○ |
| 2.1 | D < B | ○ |

As shown in Table 5 and Table 6, even if the chip is provided, it is confirmed that the spark discharge gap can be further early recovered from the fuel bridge by setting the length D to the outer diameter B or lower.

From the results of the above test, it is preferable that DB is satisfied to realize the further early recovery from the fuel bridge.

Figure 11:
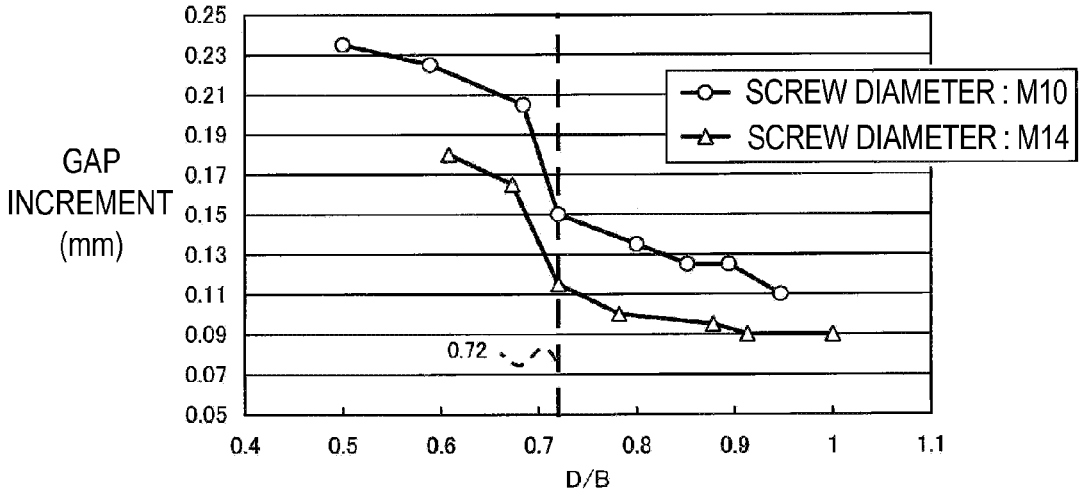
FIG. 11 is a graph illustrating a result of a durability evaluation test when a value of D/B is variously changed.

Subsequently, the samples of the spark plug in which the screw diameter of the screw portion is M10 or M14, the lateral surface of the ground electrode is formed into the curved surface shape, and the length D (mm) of the contour line of the facing surface of the ground electrode is variously changed are made, and the durability evaluation test is conducted on each of the samples. The outline of the durability evaluation test will be described below. That is, each sample is fitted to a given chamber, and a pressure within the chamber is set to 1 MPa, and electric discharge is conducted in each of the samples with a frequency of the applied voltage as 60 Hz (that is, at a rate of 3600 times per minute) for 100 hours. Then, a size of the spark discharge gap is measured after 100 hours have been elapsed, and an increment (gap increment) to the size of the spark discharge gap before test is calculated. FIG. 11 is a graph illustrating a relationship between a ratio (D/B) of the length D to the outer diameter B (mm) of the leading end surface of the center electrode, and the gap increment. Referring to FIG. 11, the test results of the sample in which the screw diameter is M10 are indicated by circles, and the test results of the sample in which the screw diameter is M14 are indicated by triangles. Also, in the samples in which the screw diameter is M10, the width of the ground electrode is set to 2.1 mm, the outer diameter B of the leading end surface of the center electrode is set to 1.9 mm, and in the sample in which the screw diameter is M14, the width of the ground electrode is set to 2.6 mm, the outer diameter B of the leading end surface of the center electrode is set to 2.3 mm.

As illustrated in FIG. 11, when D/B≥0.72 (that is, 0.72×B≤D) is satisfied, it is apparent that the gap increment can be effectively reduced, and the excellent durability can be realized. It is conceivable that this is caused by sufficiently ensuring the worn volume of the ground electrode according to the outer diameter of the leading end surface of the center electrode.

From the results of the above test, it is preferable that in order to improve the durability, 0.72×B≤D is satisfied in the configuration.

Figure 12:
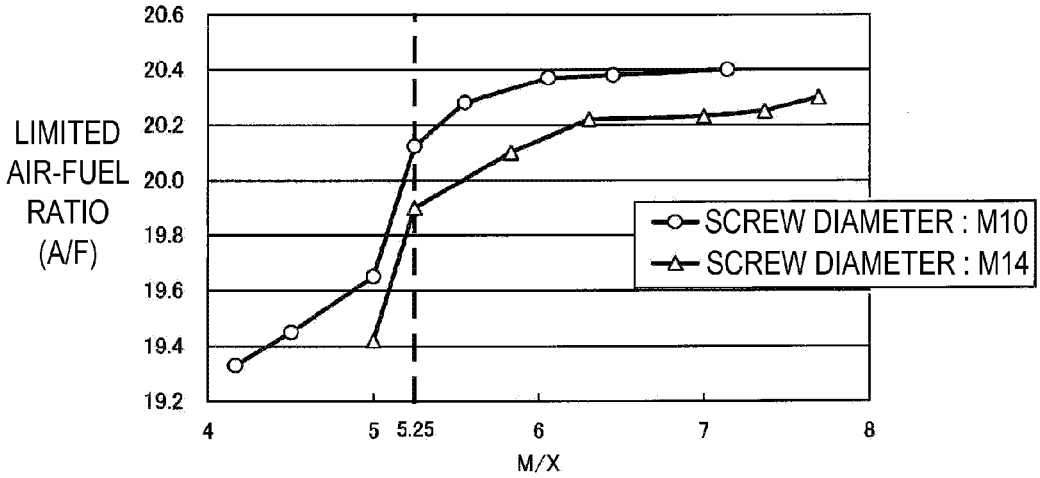
FIG. 12 is a graph illustrating a result of the durability evaluation test when a value of M/X is variously changed.

Subsequently, the samples of the spark plug in which the screw diameter M of the screw portion is M10 or M14, and the width X (mm) of the gap correspondence portion of the ground electrode is changed to variously change a value of M (screw diameter)/X are made, and the above ignition property evaluation test is conducted on each of the samples. FIG. 12 illustrates the test results of the above test. Referring to FIG. 12, the test results of the sample in which the screw diameter is M10 are indicated by circles, and the test results of the sample in which the screw diameter is M14 are indicated by triangles. Also, this test is conducted under the conditions in which the ground electrode is arranged between the fuel discharge outlet and the spark discharge gap, making it most difficult that the air-fuel mixture enters the spark discharge gap. Further, in the sample in which the screw diameter is M10, the outer diameter B of the leading end surface of the center electrode is set to 1.9 mm, the distance C is set to 0.28 mm, and the length D is set to 1.5 mm. In addition, in the sample in which the screw diameter is M14, the outer diameter B of the leading end surface of the center electrode is set to 2.3 mm, the distance C is set to 0.28 mm, and the length D is set to 1.8 mm.

As illustrated in FIG. 12, it is found that the sample that satisfies M/X≥5.25 is excellent in the ignition property. It is conceivable that this is caused by allowing the air-fuel mixture to be liable to enter the spark discharge gap because the distance from the spark discharge gap to the gap correspondence portion in the radial direction is different according to the screw diameter of the screw portion, and the width X of the gap correspondence portion is sufficiently small according to the size of the above distance.

From the results of the above test, it is preferable that in order to further improve the ignition property, it is configured that M/X≥5.25 is satisfied.

The present invention is not limited to the description of the above embodiment, but may be implemented, for example, as follows. Other applied examples or modified examples not exemplified below are also applicable.

Figure 13:
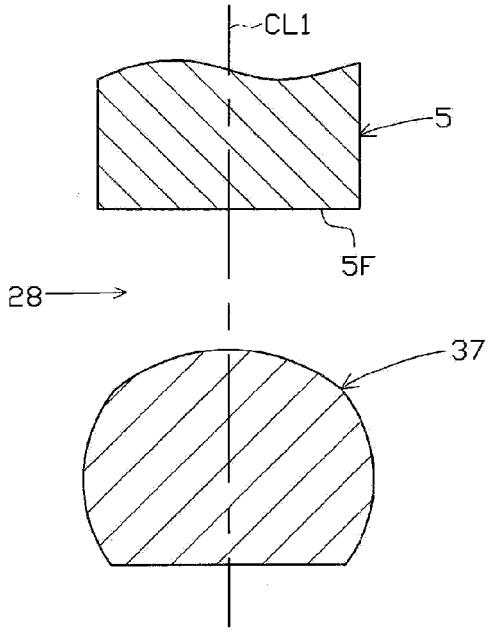
FIG. 13 is a partially enlarged cross-sectional view illustrating a shape of a ground electrode according to another embodiment.

(a) In the above embodiment, the facing surface 27F of the ground electrode 27 is formed into the flat shape, but the shape of the facing surface 27F is not particularly restricted. Therefore, for example, as illustrated in FIG. 13, a surface of a ground electrode 37, which faces the leading end surface 5F of the center electrode 5, may be formed into the curved surface shape convexed outward. In this case, the spark discharge gap can be further early recovered from the fuel bridge.

Figure 14:
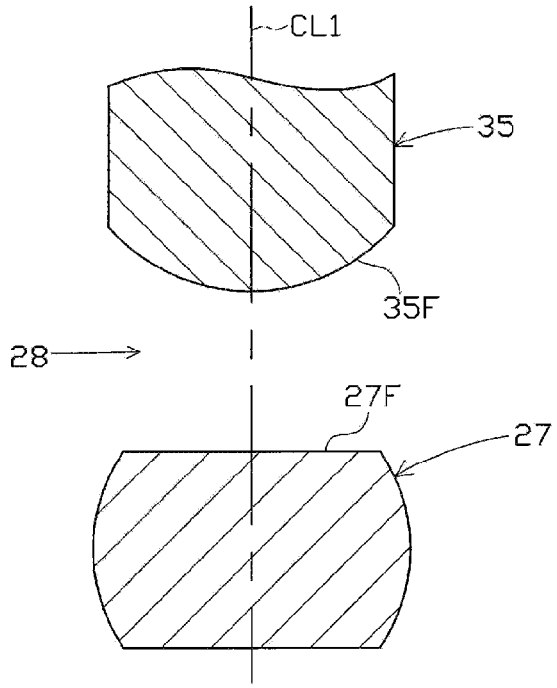
FIG. 14 is a partially enlarged cross-sectional view illustrating a shape of a center electrode according to another embodiment.

(b) In the above embodiment, the leading end surface 5F of the center electrode 5 is formed into the flat shape, but the shape of the leading end surface of the center electrode is not particularly restricted. Therefore, for example, as illustrated in FIG. 14, a leading end surface 35F of a center electrode 35 may be formed into the curved surface shape protruded toward the leading end side in the direction of the axis CL1. In this case, the early recovery effect from the fuel bridge can be further enhanced.

Figure 15:
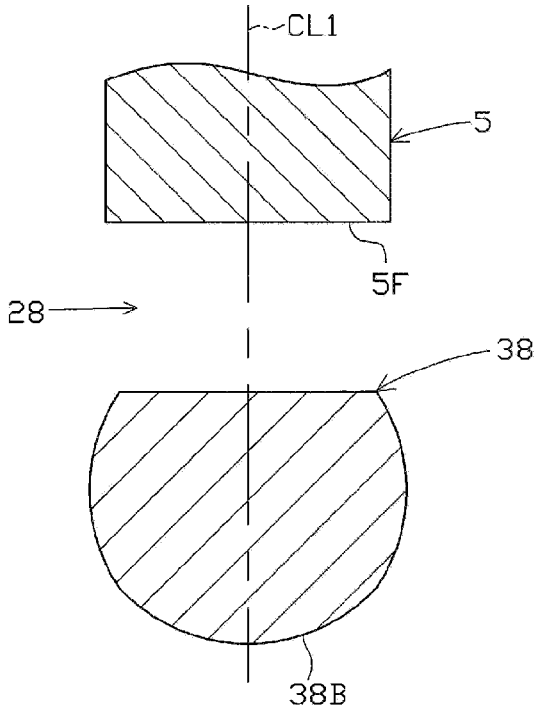
FIG. 15 is a partially enlarged cross-sectional view illustrating a shape of a ground electrode according to another embodiment.

(c) In the above embodiment, the back surface 27B of the ground electrode 27 is formed into the flat shape, but the shape of the back surface of the installation electrode is not particularly restricted, and the back surface of the ground electrode may not always be formed into the flat shape. Therefore, for example, as illustrated in FIG. 15, a back surface 38B of a ground electrode 38 may be formed into the curved surface shape convexed outward. Since the back surface 38B (particularly, the back surface of the gap correspondence portion) is formed into the curved surface shape convexed outward, the air-fuel mixture is more liable to enter the spark discharge gap 28 so as to come around the ground electrode 38. As a result, the ignition property can still be further improved.

(d) The length D of the facing surface 27F is not particularly limited. However, in the viewpoint of more surely improving the early recovery effect of the fuel bridge, it is preferable that the length D is set to be relatively small (for example, 1.5 mm or lower). On the other hand, in order to suppress the rapid ware of the ground electrode 27, and obtain the sufficient durability, it is preferable to ensure the length D to the size of some degree (for example, 1.1 mm or larger).

(e) In the above embodiment, the spark discharge gap 28 is formed between the center electrode 5 and the ground electrode 27 or the chip 32. Alternatively, a chip made of metal (for example, indium allow, or the like) excellent in the ware resistance may be disposed on the leading end of the center electrode 5, and the spark discharge gap may be formed between the chip and the ground electrode 27 or the chip 32.

(f) In the above embodiment, the case in which the ground electrode 27 is joined to the leading end portion 26 of the metal shell 3 is embodied. Alternatively, the present invention is also applicable to a case in which a part of the metal shell (or a part of a leading end fitting welded to the metal shell in advance) is ground to form the ground electrode (for example, JP-A-2006-236906, etc.).

(g) In the above embodiment, the tool engagement portion 19 is formed into the hexagonal shape in the cross-section. However, the shape of the tool engagement portion 19 is not limited to the above shape. For example, the tool engagement portion 19 may be formed into, for example, a Bi-HEX (deformed bihexagon) shape [ISO22977:2005(E)], or the like.

DESCRIPTION OF REFERENCE NUMERALS AND SIGNS

1: spark plug
2: ceramic insulator (insulator)
3: metal shell
5: center electrode
5F: leading end surface (of center electrode)
15: screw portion
27: ground electrode
27A: gap correspondence portion
27F: facing surface (of ground electrode)
27S1, 27S2: lateral surfaces (ground electrode)
31: annular space
CL1: axis
CL2: center axis (of ground electrode)

Having described the invention, the following is claimed:

1. A spark plug comprising:

a center electrode extending in an axial direction;

a cylindrical insulator provided with an axial hole into which the center electrode is inserted;

a cylindrical metal shell disposed on an outer periphery of the insulator; and a ground electrode having one end fixed to a leading end of the metal shell and another end having a facing surface that faces a leading end surface of the center electrode, wherein the spark plug has an annular space which is formed by an outer peripheral surface of the center electrode and an inner peripheral surface of the axial hole and is opened toward a leading end side in the axial direction, wherein, when C (mm) is a distance between the outer peripheral surface of the center electrode and the inner peripheral surface of the axial hole in an opening of the annular space along a direction orthogonal to the axial line, $C \geq 0.2$ mm is satisfied, and wherein, in a cross-section which includes the axial line and is orthogonal to the center axis of the ground electrode, a contour line of a lateral surface of the ground electrode, which is adjacent to the facing surface, has a curved shape which is convexed outward in relation to the facing surface of the ground electrode and a back surface of the ground electrode, wherein the lateral surface of the ground electrode is visible when viewed in both directions along a center axis of the center electrode, wherein said ground electrode has a maximum width that is narrower than a diameter of the axial hole;

wherein a contour line of the facing surface is linearly shaped in the cross-section, and wherein, when B (mm) is an outer diameter of the leading end surface of the center electrode, and D (mm) is a length of the contour line of the facing surface in the cross-section, $D \leq B$ is satisfied.

2. The spark plug according to claim 1, wherein $0.72 \times B \leq D$ is satisfied.

3. The spark plug according to claim 1, wherein $|(D-B)/2| \leq 0.25$ mm is satisfied.

4. The spark plug according to claim 1, wherein an outer peripheral surface of the metal shell includes a screw portion configured to be screwed with a fitting hole of a combustion device, wherein the ground electrode includes a gap correspondence portion which is a portion at the leading end side of the leading end surface of the center electrode in the axial direction and at a rear end side of the facing surface of the ground electrode in the axial direction, and wherein, when M (mm) is a screw diameter of the screw portion, and X (mm) is a width of the gap correspondence portion, $M/X \geq 5.25$ is satisfied.

* * * * *